United States Patent [19]

Pedersen

[11] Patent Number: 4,914,789

[45] Date of Patent: Apr. 10, 1990

[54] CLOSURE CLIP MEMBER FOR FLEXIBLE BAGS AND THE LIKE

[76] Inventor: Oliver L. Pedersen, 14050 Madison Ave. NE., Bainbridge Island, Wash. 98110

[21] Appl. No.: 259,162

[22] Filed: Oct. 18, 1988

[51] Int. Cl.[4] ..... B65D 77/10

[52] U.S. Cl. ..... 24/30.5 S; 24/563

[58] Field of Search ..... 24/30.5 S, 30.5 R, 30.5 L, 24/563, 30.5 P, 561; 383/25, 293, 71

[56] References Cited

U.S. PATENT DOCUMENTS 3,170,213 2/1965 Thomas, Jr. ..... 24/30.5 S X

FOREIGN PATENT DOCUMENTS 203937 6/1959 Austria ..... 24/30.5 S
1218932 6/1966 Fed. Rep. of Germany ... 24/30.5 S
1234618 2/1967 Fed. Rep. of Germany ... 24/30.5 S
1255105 1/1961 France ..... 24/30.5 S
1353431 1/1964 France ..... 24/30.5 S

*Primary Examiner*—James R. Brittain
*Attorney, Agent, or Firm*—George M. Cole

[57] ABSTRACT

A closure clip member (10) for flexible bags, sacks and the like in the shape of a disk with an enlarged edge rim (12) and a thinner body portion or diaphragm (14); the body portion (14) being divided by radially disposed slots (22) into a predetermined number of triangular leafs (20) with the apexes (24) of the leafs adjacent each other at or near the center of the body. Each triangular (20) leaf includes a void area adjacent the edge rim (12) so that each leaf is "L" shaped; said closure member being formed of flexible, planar plastic material so that the closure member (10) can be manually slipped on and off a bag or sack.

7 Claims, 2 Drawing Sheets

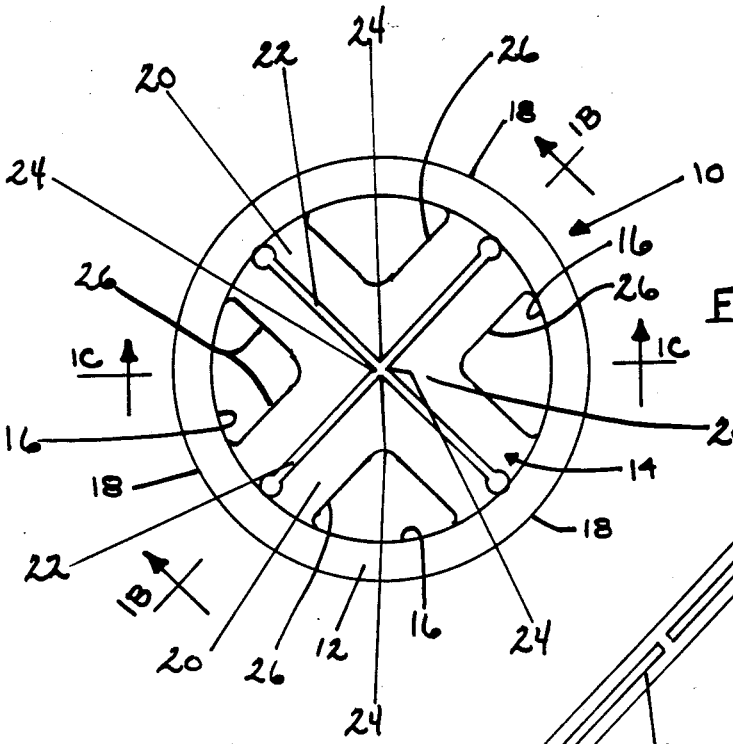
FIG. 1A
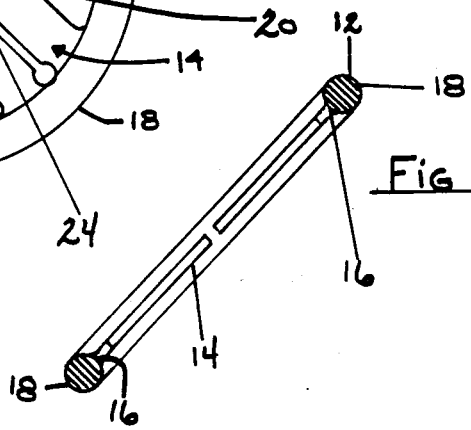
FIG 1B
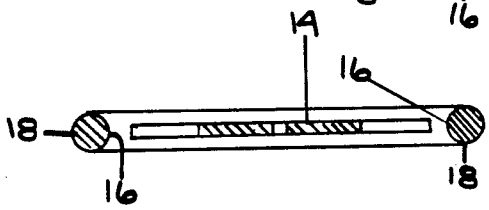
FIG 1C
FIG 2A
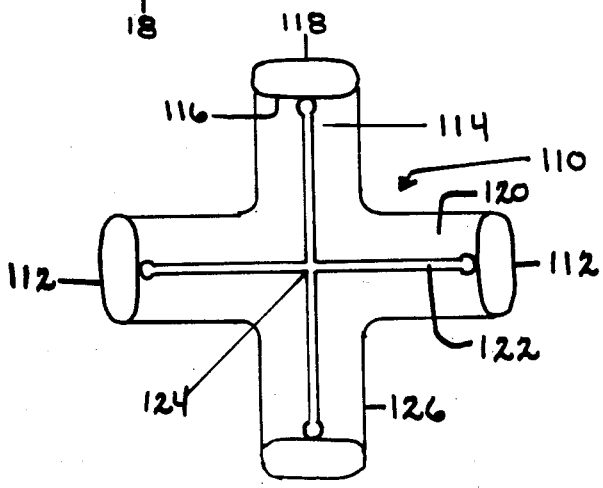
FIG 2B
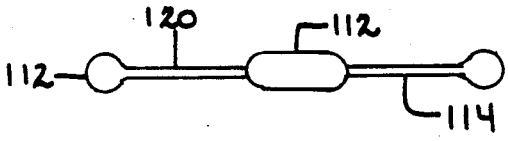

FIG 3
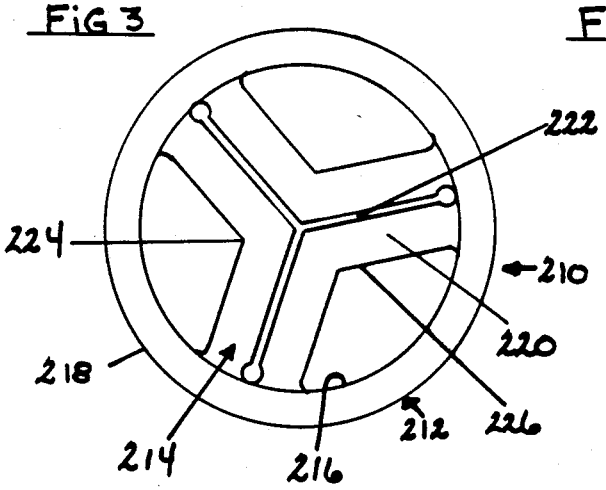
FIG 4
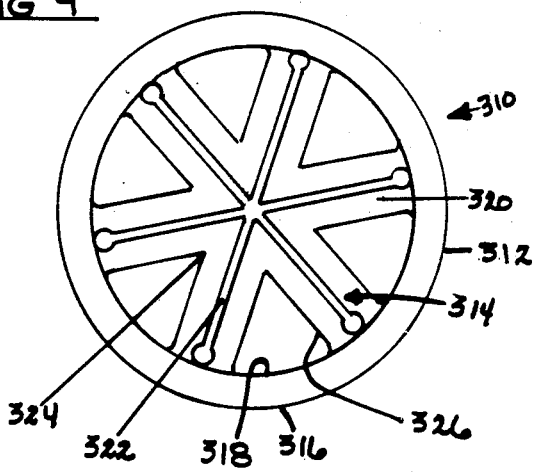
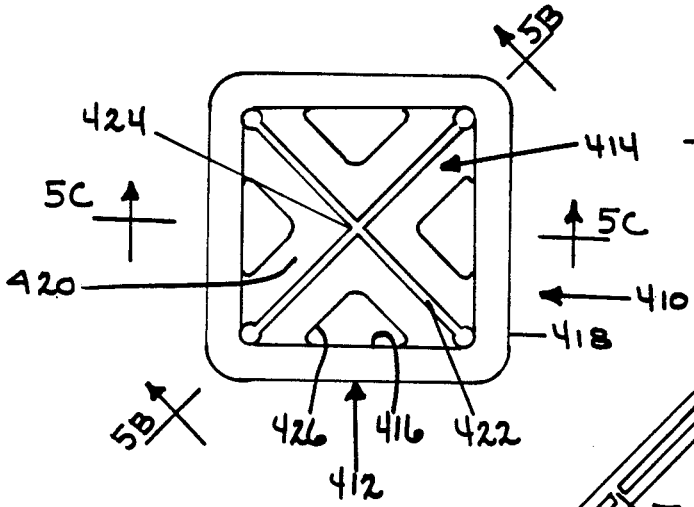
FIG. 5A
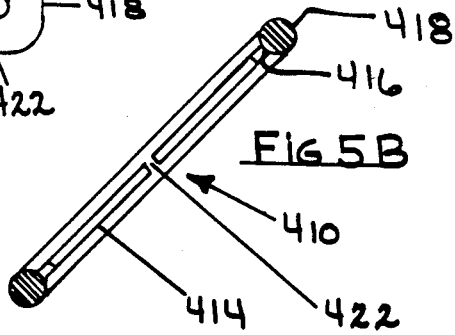
FIG 5B
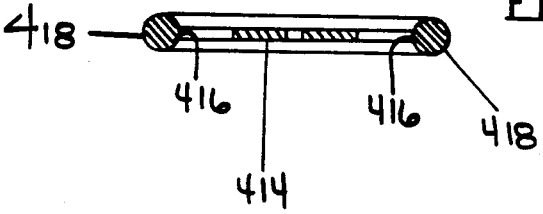
FIG 5C

CLOSURE CLIP MEMBER FOR FLEXIBLE BAGS AND THE LIKE

TECHNICAL FIELD

The invention relates to the field of closure members for bread loaf wrappers and plastic bags and the like and more particularly to a closure member for plastic bags and the like wherein the closure member effects a more positive closing of the sack or bag.

BACKGROUND ART

Those skilled in the art and householders are aware of the current closure devices used to hold bread wrappers, trash bags and other flexible sacks and containers which can be twisted into a neck at the open end and a clip slipped on or a wire wrapped around the neck to secure closing of the bag. The slotted clip, for instance, that is used on bread wrappers is a simple device which breaks too easily and has a habit of frequently coming off completely or partially slipping off the twist. Additionally it is difficult for some people to manipulate and all too often the points of the clip tear the wrapper. As far as wire type closure members are concerned the paper tears off easily leaving bare wire which is hard to handle. With bare wire there is always the danger that someone can be poked or jabbed, especially small children. The more involved handling of the wire wrap closure and its greater complexity in being manipulated makes it unpopular with many householders.

Applicant is not at the time of filing this patent application aware of prior art patents which would anticipate the structural and functional principals of the instant device.

DISCLOSURE OF INVENTION

The invention is a novel closure clip device which is preferably round and has an ring shaped rim or edge with a round cross section. On the inside of the edge rim is a relatively thin and flat sheet portion of lesser thickness than the diameter of the edge rim. The inner flat portion is divided into a predetermined number of leaf sections which are defined by slots extending diametrically across through the flat inner portion from inside edge to inside edge of the edge rim. The number of leafs may vary but in any event they will be triangularly shaped. To reduce the amount of material in the closure device a part of each leaf may be void between the edge rim and the edge of the leaf. The leafs are flexible and because of the design of the closure member easily "give" or flex when slipped onto a bag or flexible container.

Accordingly, it is among many features that the device provides a better seal than known plastic clip devices such as are used on bread wrappers, and therefore holds air better than known clips. The device is stronger and therefore breaks less readily. The invention is easier to apply and remove. The device is rugged, durable and less expensive than commonly known and used closure members such as wire wrappers.

BRIEF DESCRIPTION OF THE DRAWINGS

FIG. 1A is a plan view showing details of a preferred configuration of the invention;

FIG. 1B is a cross section view of the view of FIG. 1A taken along the line 1B—1B of FIG. 1A;

FIG. 1C is a cross section view taken along the line 1C—1C of FIG. 1A—1A;

FIG. 2A shows an alternative embodiment of the invention in which the invention has a discontinuous edge rim section;

FIG. 2B is a side elevation view of the article of FIG. 2A and showing additional details of its design;

FIG. 3 shows a three leaf form of the invention with a continuous edge rim as in FIG. 1A;

FIG. 4 shows a six leaf configuration of the invention of the FIG. 1A;

FIG. 5A shows an article similar to FIG. 1A except that the overall shape is generally square rather than round; and FIGS. 5B and 5C are cross sectional views taken along the lines 5B—5B and 5C—5C respectively of FIG. 5A.

BEST MODE FOR CARRYING OUT THE INVENTION

Referring now to the drawings it will be seen in FIGS. 1 to 3 that the closure member therein illustrated has an edge rim portion generally designated by the number 12 and a flat, planar body portion generally designated by the number 14 formed on the inside of rim 12.

Edge rim portion 12 is shown to have a round cross section with an inside surface 16 and an outside surface 18. The flat body portion 14 is integrally formed with the edge rim 12 and has a predetermined thickness of about ¼ to ⅓ that of the diameter or thickness of the edge rim.

The body portion 14 is as mentioned above a flat planar sheet divided into triangular sections or leafs 20 by slots 22 which extend on a diameter line across the body from near the inside surfaces 18. In this embodiment the slots 22 are at ninety degrees to define four triangular leafs 20. Each leaf has a point 24 at or near the center of the round body. Each leaf has a cut-out section along the inside surface 16 and in spaced relation to the working edges formed by slots 22 to define inside edges 26.

For purposes of illustration the disk shaped closure members may range in size from as small as one half inch in overall diameter to as much as two inches. A preferred size is approximately 1¼ inches in overall diameter with the edge ring having a cross sectional thickness or diameter of about 1/16 to about 3/16 inches. The body portion will have a range of thickness from about 0.015 to about 0.050 inches. The preferred thickness of the planar body 14 is from about 0.020 to about 0.035 inches. The width of the slots 22 is approximately 1/100 to about 1/16 inches, with a width of 1/64 to 1/32 being the preferred.

While the embodiment of FIGS. 1A to 1C is shown to have a continuous edge rim, the embodiment of FIGS. 2A and 2B is shown to have a discontinuous edge rim. Thus there are four enlarged edge rim sections 112 to interconnect and make integral the leaf portions 120 with each other and with the four separate rim sections.

FIG. 3 shows a three leaf embodiment and FIG. 4 shows a six leaf embodiment. In FIG. 3 the slots 222 are formed on radius lines to the center of the body 214 while in FIG. 4 the slots extend across the body on diameter lines.

The embodiment of FIGS. 5A through 5C illustrates that the invention embraces a square form as well as a round or circular form.

The plastic material out of which the closure member 10 is made is preferably a low density polyethylene. The desirable properties of the plastic material are that it is reasonably flexible and yet stiff enough to serve its purpose, that is to hold the sack or bag closed. In this regard it is desirable that the plastic have memory or the property of returning to its original shape after being flexed or bent. Consistent with the ability to bend or flex the plastic must be reasonably resistant to cracking along bend or flex lines. Also the householder must be able to manipulate the device without a need for undue strength.

I claim:

1. A closure member for flexible bags, sacks and the like, comprising:

(a) a generally flat, planar, disk-like plastic body of predetermined, uniform thickness, said body being made of plastic material which is resilient, flexible and springy and which can be repeatedly flexed without fatigue stress and cracking, said body being of predetermined shape and having a perimeter, (b) said body being divided into a predetermined number of triangular leaf sections defined by slot means formed in said body, said slot means being formed generally on diameter lines radiating generally from the center of said body to a point near the edge perimeter portion thereof and so that each leaf section has a point adjacent to said center separated by the width of said slot means, said slot means defining two side edges for each of said triangular leaf sections, (c) an enlarged edge rim formed on the perimeter of said body such that said edge rim is of greater thickness than said body and has a predetermined cross sectional shape, said edge rim having an outer surface and also having an inner surface which is integrally formed with said body, and (d) each of said triangular leaf sections having void areas therein between the inner surface of said edge rim and the two side edges of said leaf section such that each said leaf is generally "L" shaped and such that each end of said "L" shape is integrally formed with and attached to said edge rim.

2. The closure member according to claim 1 and wherein said edge rim is round in cross section.

3. The closure member according to claim 1 and wherein said edge rim is from 0.075 to 0.187 inches thick through its cross section.

4. The closure member according to claim 1 and wherein said body is from 0.015 to 0.050 inches in thickness.

5. The closure member according to claim 1 and wherein said body is from 0.020 to 0.035 inches in thickness.

6. The closure member according to claim 1 and wherein said closure member is from ½ to 2 inches across its largest dimension.

7. The closure member according to claim 1 and wherein said closure member is generally square in shape.

* * * * *